US006155016A

United States Patent [19]

Wacker et al.

[11] Patent Number: 6,155,016

[45] Date of Patent: Dec. 5, 2000

[54] WALL STRUCTURE

[75] Inventors: Jarmo Wacker, Kaarina; Kari Ruusunen, Turku, both of Finland

[73] Assignee: Kvaerner Masa-Yards Oy, Helsinki, Finland

[21] Appl. No.: 09/076,526

[22] Filed: May 12, 1998

[30] Foreign Application Priority Data

May 13, 1997 [FI] Finland ..... 972025

[51] Int. Cl.[7] ..... E04B 2/28

[52] U.S. Cl. ..... 52/588.1; 52/265; 52/783.17; 52/783.19; 52/797.1

[58] Field of Search ..... 52/579, 588.1, 52/797.1, 783.17, 783.19, 265, 267, 269

[56] References Cited

U.S. PATENT DOCUMENTS 4,722,154 2/1988 Virta et al. .
4,832,308 5/1989 Slonimsky et al. .
5,706,614 1/1998 Wiley, Jr. et al. ..... 52/783.19

FOREIGN PATENT DOCUMENTS 2 552 017 3/1985 France .
36 14 405 12/1987 Germany .
39 03 511 8/1990 Germany .

*Primary Examiner*—Michael Safavi
*Attorney, Agent, or Firm*—John Smith-Hill; Smith-Hill and Bedell

[57] ABSTRACT

A fire resistant and sound insulating wall structure, particularly for the ship building industry, includes vertical stiffeners and a surface plate attached to the vertical stiffeners, preferably by gluing. A relatively thin corrugated plate is attached to the surface plate by gluing. The corrugations of the corrugated plate are substantially horizontally oriented and accordingly the corrugated plate provides horizontal stiffness. The glue attachment of the surface plate to the vertical stiffeners is preferably secured by means of screws for maintaining the fire-resisting properties of the structure in the event of the glue being destroyed by the heat of a fire.

19 Claims, 2 Drawing Sheets

5
1
12
2
4
8
9
5a
17
18
16
15
3
7a 7a
7
4
5a
6a
-8-
5
6
3
4c
3
4b
10
11
2
1
4a
1
2

7a
7
4
5a
6
-8-
6a
5
3
9
4c
3
4b
4a
11
2
1
10
2
1

5
3
14
12
2
1
13

WALL STRUCTURE

BACKGROUND OF THE INVENTION

This invention relates to a wall structure.

In particular in the ship building industry, the aim is to make the interior structure of a ship or other marine construction light and uncomplicated while preserving good fire-resisting and sound insulating properties. If the wall of a cabin or like structure can be made thin, the weight of the structure is generally reduced and the work of assembling and/or installing the structure is easier.

The object of the invention is to provide a wall structure which is thin and relatively light, is sufficiently stiff vertically as well as horizontally and has good fire-resisting and sound-insulating properties. The fire-resisting properties of the wall structure should meet a high standard and the sound-insulation should be good, in particular within the frequency range 100 to 200 Hz.

SUMMARY OF THE INVENTION

According to the invention, the wall structure includes a relatively thin corrugated plate providing horizontal stiffening. This means that the crests and grooves of the corrugation are at least substantially horizontally oriented. The structure also includes a conventional surface plate, to which the corrugated plate is attached by gluing. The surface plate is attached to vertical stiffeners, preferably by gluing, and this glue attachment should preferably be secured by means of screws or the like for maintaining the fire-resisting properties of the structure in the event of the glue being destroyed by the heat of a fire. There is no direct connection between the corrugated plate and the vertical stiffeners.

An assembly including a surface plate attached to a vertical stiffener and attached by gluing to a horizontally stiffening corrugated plate forms a sufficiently stiff structure that the thickness of the assembly between the vertical stiffeners can in many applications be as little as 5 to 10 mm. This structure can be provided, by gluing or by other attachment means, with a soft insulating layer, for instance a glass or rock wool layer, the thickness of which advantageously can be about 10 mm. The use of two or more superimposed insulating layers improves the fire-resisting as well as the sound-insulating properties of the structure. A structure of this kind has proved to be highly advantageous as a wall structure erectable at the building site or for use in prefabricated room units such as passenger cabins.

Most favorably the invention can be applied in the form of a relatively thin wall. If one wants a very strong wall with particularly good fire-resisting properties, the total thickness of the corrugated plate may be 20 mm. (As used herein, the plate thickness, or overall thickness, of a corrugated plate means the overall distance between the two main faces of the corrugated plate, as distinct from the material thickness, which is the local thickness before corrugation and is generally much less than the plate thickness.) Generally, it is not warranted to use the corrugated plate thicker than 15 mm. Normally, the height of the corrugations is at the most 8 mm, preferably at the most 6 mm. This gives a quite satisfactory stiffness, if the material used is steel. At the same time, good sound-insulation and good fire resistance are obtained. A fire-proof insulation layer attached to the steel structure improves these properties. Rock wool is a reliable insulation material. The fire resistance of glass wool is not as good as that of rock wool because glass wool melts at a considerably lower temperature than rock wool.

A single layer soft rock wool mat or a stiffer panel-like rock wool unit is in general sufficient as an insulating layer.

Its density is advantageously 100 to 200 kg/m$^3$, preferably 150 to 200 kg/m$^3$. An insulation with a higher density is as a rule better as fire insulation than an insulation of lower density. The panel-like element has the advantage that it is self-supporting and may therefore be easier to install.

It is of advantage that the corrugated plate provides a sufficiently large gluing surface. At each crest of the corrugations, which are to be glued to the surface plate, a plane surface or land with a width of several millimeters, preferably about 5 mm, can be formed. This provides an extremely reliable and strong gluing attachment of the corrugated plate.

The corrugations of the corrugated plate may also be formed with a sharp bend giving them a trapezoid configuration. Then the portions between the extreme parts of the corrugations, i.e. the flanks of the corrugations, are generally linear. The angle between the flanks and the wall plane should not be made too large, because too large an angle makes it more difficult to bore holes and install screws through the wall. An angle of 30° to 45°, preferably 30° to 40° is recommended.

Coated steel is a suitable material for the corrugated plate and the surface plate. In this context "coated" includes all kinds of coating measures, such as painting, galvanizing, plastic covering, etc. The surface plate may be a 0.7 or 0.6 mm thick plate having a coating of PVC at the surface away from the corrugated plate and painted at the surface toward the corrugated plate. The corrugated plate may be made of a galvanized steel plate having a material thickness of 0.5 mm. The thickness of the surface plate and the material thickness of the corrugated plate should be selected so that a sufficient stiffness and fire resistance is obtained. The stiffness is considerably influenced by the distance between the vertical stiffeners. If one wants a particularly light wall structure, aluminum may be used for the surface plate and/or the corrugated plate, but such a structure is considerably more expensive than a steel structure.

The vertical stiffeners may with advantage be steel tubes of rectangular cross-section. Other profile elements of steel or other metals can be used as well. For obtaining a sufficient stiffening, it is of advantage that the dimension of the stiffener perpendicularly to the wall plane is considerably greater than the overall thickness of the corrugated plate. Thereby a space is created between the vertical stiffeners, into which insulating material can easily be placed.

A wall according to the invention can be assembled of wall elements or panels attached to one another side by side, each having a vertical stiffener at one vertical edge. The surface plate is attached, preferably by gluing, to the vertical stiffener. During assembly of the wall, the surface plate of the adjacent wall element is attached to the same stiffener, preferably by means of screws, rivets or the like. It is recommended that both vertical edges of the surface plate are provided with bends parallel to one side of the vertical stiffener. These bends may also have a continuation in the form of a second bend more or less parallel to the wall plane. These bends have a stiffening influence on the wall elements and make their joining to one another easier.

The horizontal width of the wall elements in the wall plane may be chosen to fit a module system. Too broad wall elements are difficult to handle. A width of 80 to 150 cm, preferably 85 to 100 cm is recommended.

In a preferred embodiment, the corrugated plate is fitted between a vertical stiffener of a wall element and a bent portion of the surface plate at its remote vertical edge. It is of advantage that the horizontal length of the corrugated plate corresponds as close as possible to the horizontal dimension of the space provided for the corrugated plate. The clearance required for fitting in the corrugated plate is thus kept at a minimum. Thereby the best sound insulation and the best fire resistance are obtained. For the same reason, the insulating layer that is to be glued to the corrugated plate may be made somewhat overdimensioned relative to the space provided for it. Its unloaded horizontal dimension is then somewhat greater than the corresponding dimension of the corrugated plate.

The fire resisting properties of the wall structure may be improved by securing the glued attachment of the corrugated plate and of the insulating layer by means of heat-resisting attachment elements. These can be screwed or riveted to the vertical stiffeners. In particular, if two superimposed insulating layers are used, such attachment elements improve the wall's fire-resistant properties.

A wall structure in accordance with the invention may be used as an exterior wall of a prefabricated cabin unit for installation in a passenger ship. The surface plate faces the interior of the cabin and the corrugated plate (or the insulation layer glued to the corrugated plate) faces a concealed space, such as a clearance between two adjacent cabin units.

BRIEF DESCRIPTION OF THE DRAWINGS

In the following, the invention will be described more in detail with reference to the accompanying schematic drawings, wherein.

DETAILED DESCRIPTION

Figure 1:
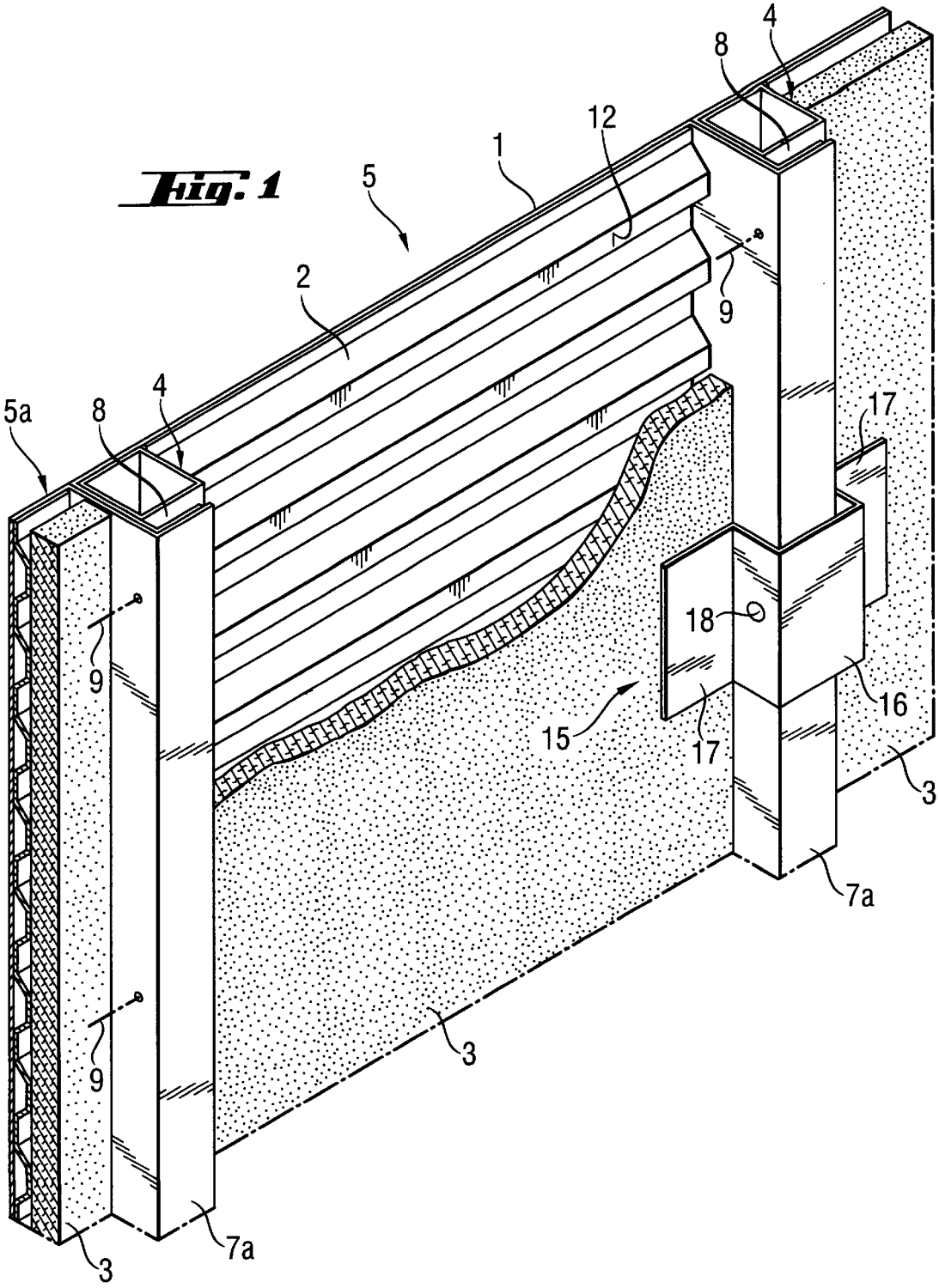
FIG. 1 shows, partly in section, the rear side of a wall structure according to the invention.

The wall structure shown in the drawings comprises a surface plate 1, a corrugated plate 2, an insulation layer 3 and a vertical stiffener 4. In the embodiment shown, the surface plate 1 is a 0.7 mm steel plate coated with PVC on its side away from the corrugated plate 2. The corrugated plate 2 is made of a 0.5 mm galvanized steel plate. The galvanizing layer is thin, because a too thick galvanizing layer may impair the fire resistance of the wall structure.

Figure 4:
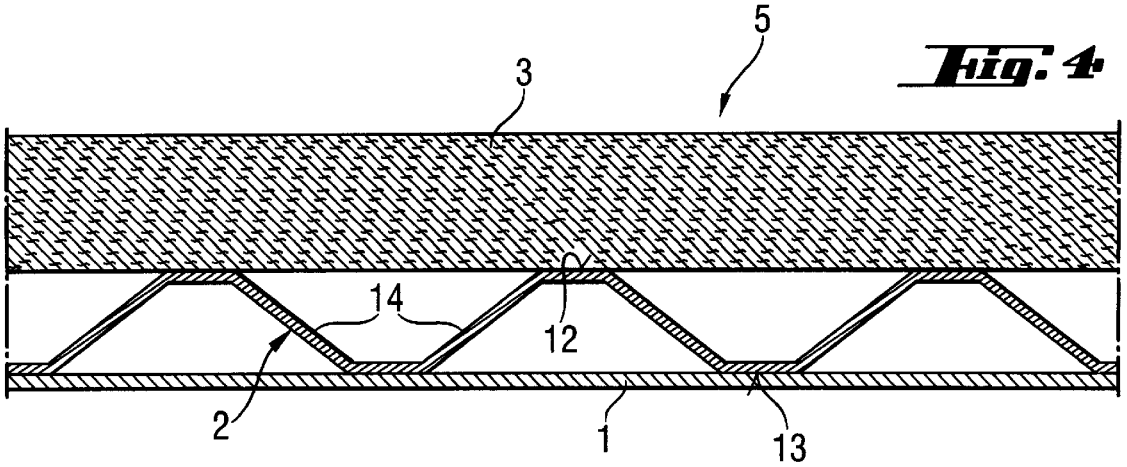
FIG. 4 is an enlarged vertical sectional view of a wall structure according to the invention.

The corrugations are horizontally oriented. The form of the corrugations is shown in FIG. 4. The vertical stiffeners 4 are made of substantially rectangular steel tubes 25×25 mm. The insulation layer 3 is rock wool of 10 mm thickness.

Figure 2:
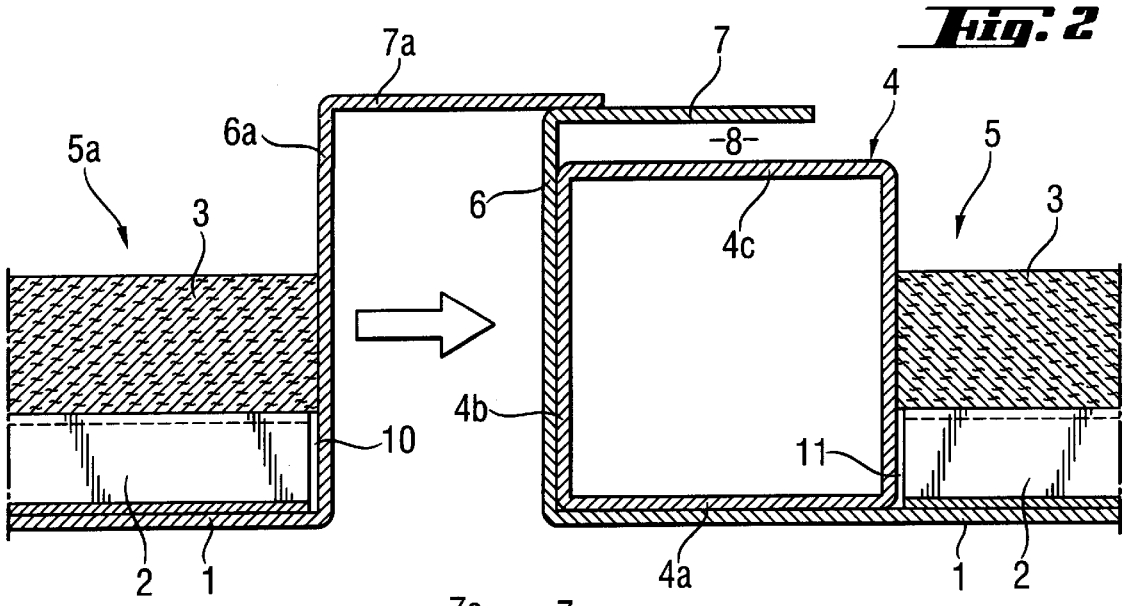
FIG. 2 shows a horizontal section of two wall elements according to the invention in their joining phase.
Figure 3:
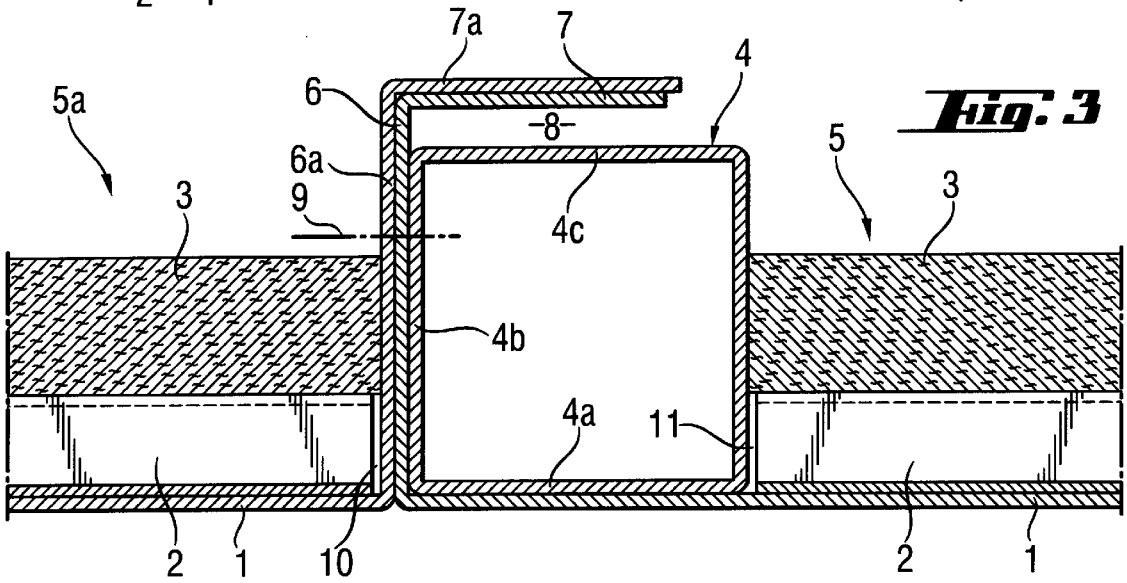
FIG. 3 shows the two wall elements of FIG. 2, in joined position.

In the embodiment shown, the wall element or panel 5 has a vertical stiffener 4 at only one edge. FIGS. 2 and 3 show how the surface plate 1 is bent at the vertical edge at which the stiffener 4 is provided. There are two bends, a first or return bend 6 perpendicular to the wall plane and a second or reverse bend 7 in the direction of the wall plane. In this manner, the surface plate wraps partially around the stiffener 4. The stiffener 4 has two side surfaces 4*a* and 4*b* to which the surface plate 1 is glued. Between the back surface 4*c* of the vertical stiffener and the reverse bend 7 of the surface plate there is a gap 8 of some millimeters for facilitating assembly of the wall element 5.

The surface plate also has two bends at its other vertical edge, where there is no vertical stiffener. This is shown in FIGS. 2 and 3 in connection with the adjacent wall element 5*a*, in which the surface plate has two bends 6*a* and 7*a*. The bend 6*a* is so dimensioned that the bend 7*a* is in face-to-face contact with the reverse bend 7 of the wall element 5 when the surface plates 1 of both the wall elements 5 and 5*a* are aligned.

The wall elements 5 and 5*a* have a horizontal width of approximately 100 cm. The joint between the two wall elements is secured by means of several attachment screws (not shown), which are installed at different heights at the position of the line 9. These screws also secure the glued attachment of the surface plate 1 of the wall element 5 to the vertical stiffener 4. The small gaps 10 and 11 between the corrugated plate 2 and the bend 6*a* and the vertical stiffener 4, respectively, allow installation of the corrugated plate 2 but should be kept as small as possible. No such gaps are provided at the vertical edges; of the insulation layer 3. On the contrary, the insulation layer is slightly in compression between the vertical stiffener 4 and the bend 6*a*. If two superimposed insulation layers are used, the second or outer layer is attached after the screws at line 9 have been installed.

FIG. 1 shows how the glued attachment of the corrugated plate 2 and the insulation layer 3 may be secured by, for example, a metallic fastening element or bracket 15. Only one such element is shown, but several of these are preferably used at each vertical stiffener 4. Although the element 15 is relatively short in its vertical dimension, it is also possible to increase the vertical dimension of the element 15 so that the element 15 is more strip-like. Elements 15 are used especially if a second separate insulation layer is placed over the insulation layer 3. The element 15 includes a central part 16 extending over the vertical stiffener 4 and the bends of the surface plates 1. The central part 16 is U-shaped if necessary. At both sides of the central part 16 there is a relatively broad support flange 17 slightly pressing against the insulation layer 3. The central part 16 is at one or both sides attached to the vertical stiffener 4 by means of one or several screws or rivets 18, if there is space enough for that. If not, the attachment is made at the backside 4*c* of the vertical stiffener 4.

FIG. 4 shows the corrugated plate 2, in which the corrugations have been made by bending the plate so that, at both sides of the plate, a number of coplanar plane surfaces or lands 12 and 13 are formed, each with a width of almost 5 mm and suitable for gluing attachment. The surface plate 1 is glued to the plane surfaces 13 and the insulation layer 3 to the surfaces 12. The surfaces 12 and 13 may include small apertures, recesses or other unevennesses or tooth, by means of which a larger adhesion area is created for the glue. The use of an inorganic glue increases fire safety, but also organic glues may be used in many cases, for example, polyurethane glues. The total thickness of the corrugated plate 2 is approximately 7 mm. The sections 14 of the corrugated plate between the plane surfaces 12 and 13 are at an angle of approximately 40 degrees to the wall plane.

The wall structure described above is favorable with respect to sound insulation properties, because the lack of a direct connection between the vertical stiffeners and the corrugated plate means that vibrations, including sound, transmitted to the vertical stiffeners from the structure on which they are supported, such as an underlying deck or the like, or to which they may be attached, such as the floor and ceiling of the surrounding structure, are not easily transmitted to the corrugated plate. Because the surface plate is attached to the corrugated plate by adhesive bonding, which is more yielding than direct metallic contact, e.g. welding, vibrations, including sound, transmitted from the vertical stiffener to the surface plate are effectively damped. Further, attaching the corrugated plate to the surface plate by adhesive bonding is relatively simple and inexpensive because it does not require skilled labor.

The invention is not restricted to the embodiments shown, but several modifications thereof are feasible with the scope of the attached claims.

What is claimed is:

1. A wall structure comprising:

at least first and second vertical stiffening elements, a metal surface plate rigidly attached to the first and second stiffening elements, a corrugated plate adhesively bonded to the surface plate, the corrugated plate having corrugations which are substantially horizontally oriented, for imparting horizontal stiffness to the wall, and have a height no greater than 20 mm, and an insulating layer at one side of the corrugated plate and coextensive with the corrugated plate.

2. A wall structure according to claim 1, wherein the corrugated plate has ridges at which the plate is adhesively bonded to the surface plate, the ridges having substantially plane surfaces each of a width of several millimeters.

3. A wall structure according to claim 2, wherein the corrugated plate has flanks connecting ridges at opposite sides of the corrugated plate, and the flanks are substantially linear and are inclined at 30–45° to the surface plate.

4. A wall structure according to claim 1, wherein the surface plate and the corrugated plate are made of steel.

5. A wall structure according to claim 1, wherein the surface plate and the corrugated plate are made of coated steel.

6. A wall structure according to claim 1, wherein the vertical stiffening elements are substantially thicker perpendicular to the surface plate than the overall thickness of the corrugated plate, and the insulating layer is between the vertical stiffening elements.

7. A wall structure according to claim 6, wherein the insulating layer is a rock wool mat.

8. A wall structure according to claim 6, wherein the insulating layer is in a state of compression between the vertical stiffening elements.

9. A wall structure according to claim 1, wherein each vertical stiffening element includes a steel tube of substantially rectangular cross-section.

10. A wall structure according to claim 1, wherein the height of the corrugations of the corrugated plate is no greater than 15 mm.

11. A wall structure according to claim 1, wherein the height of the corrugations of the corrugated plate is no greater than 8 mm.

12. A wall structure comprising:

at least first and second vertical stiffening elements, a metal surface plate rigidly attached to the first and second stiffening elements, a corrugated plate adhesively bonded to the surface plate, the corrugated plate having corrugations which are substantially horizontally oriented, for imparting horizontal stiffness to the wall, and have a height no greater than 20 mm, and a flexible insulation layer glued to the corrugated plate, such that the corrugated plate is between the insulation layer and the surface plate.

13. A wall structure according to claim 12, comprising heat resistant fastening elements attached to the vertical stiffening elements by fire resistant means, said heat resistant fastening elements securing the insulation layer against the corrugated plate.

14. A wall structure comprising:

at least first and second vertical stiffening elements, a metal surface plate rigidly attached to the first and second stiffening elements, and a corrugated plate adhesively bonded to the surface plate, the corrugated plate having corrugations which are substantially horizontally oriented, for imparting horizontal stiffness to the wall, and have a height no greater than 20 mm, and wherein the wall structure is composed of at least first and second wall panels each having first and second vertical edges, the first and second wall panels include the first and second vertical stiffening elements respectively, each at the first vertical edge of the respective panel, and the first wall panel is attached at its first vertical edge to the second vertical edge of the second wall panel.

15. A wall structure according to claim 14, wherein the first and second vertical edges of the wall panels are at a distance of 80–150 cm.

16. A wall structure comprising:

at least first and second vertical stiffening elements, a metal surface plate rigidly attached to the first and second stiffening elements, a corrugated plate adhesively bonded to the surface plate and having no direct connection to the vertical stiffening elements, the corrugated plate having corrugations which are substantially horizontally oriented, for imparting horizontal stiffness to the wall, and have a height no greater than 20 mm, and an insulating layer at one side of the corrugated plate and coextensive with the corrugated plate.

17. A substantially rectangular panel for a wall structure, said panel having first and second opposite edges and comprising:

at least a first substantially straight, elongate stiffening element extending along the first edge of the panel and resisting bending of the panel in a first dimension, a single substantially rectangular metal surface plate having first and second opposite edges, the single surface plate being rigidly attached at its first edge to the first stiffening element, a corrugated plate adhesively bonded to the single surface plate, the corrugated plate having corrugations which have a height no greater than 20 mm and are oriented substantially perpendicular to the first stiffening element, for imparting stiffness to the panel with respect to bending in a second dimension, perpendicular to the first dimension, the corrugated plate having no direct connection to the first stiffening element, and a flexible insulating layer glued to the corrugated plate, such that the corrugated plate is between the insulating layer and the single surface plate.

18. A substantially rectangular panel for a wall structure, said panel having first and second opposite edges and comprising:

at least a first substantially straight, elongate stiffening element extending along the first edge of the panel and resisting bending of the panel in a first dimension, a single substantially rectangular metal surface plate having first and second opposite edges, the single surface plate being rigidly attached at its first edge to the first stiffening element, and a corrugated plate adhesively bonded to the single surface plate, the corrugated plate having corrugations which have a height no treater than 20 mm and are oriented substantially perpendicular to the first stiffening element, for imparting stiffness to the panel with respect to bending in a second dimension, perpendicular to the first dimension, the corrugated plate having no direct connection to the first stiffening element, and wherein the single surface plate includes a planar portion to which the corrugated plate is bonded and, at its first edge, a flange having a return portion extending perpendicular to the planar portion of the plate and a reverse portion extending parallel to the planar portion of the plate, and wherein the first stiffening element is attached to the single surface plate by adhesive bonding to the planar portion and to the return portion of the flange.

19. A panel according to claim 18, wherein the single surface plate includes, at its second edge, a second flange having a return portion extending perpendicular to the planar portion of the plate and an extension portion extending parallel to the planar portion of the plate, whereby a wall structure can be built of first and second panels with the first panel attached at its first edge to the second edge of the second panel and the first flange of the first panel and the second flange of the second panel being nested.

* * * * *